United States Patent [19]

Gaynes

[11] Patent Number: 4,660,724

[45] Date of Patent: Apr. 28, 1987

[54] MODULAR CONTAINER

[76] Inventor: Chester Gaynes, 1642-52 W. Fulton St., Chicago, Ill. 60612

[21] Appl. No.: 821,710

[22] Filed: Jan. 23, 1986

[51] Int. Cl.[4] ..... B65D 21/02; B65D 21/04

[52] U.S. Cl. ..... 206/509; 206/511; 206/512; 220/1.5; 220/23.4; 220/23.6

[58] Field of Search ..... 220/1.5, 23.4, 23.6; 206/508, 509, 511, 512, 503, 504

[56] References Cited

U.S. PATENT DOCUMENTS

| | | | |
|---|---|---|---|
| 3,586,204 | 6/1971 | Roper | 206/512 |
| 4,000,704 | 1/1977 | Griffin | 206/511 |

FOREIGN PATENT DOCUMENTS

| | | | |
|---|---|---|---|
| 30064 | 6/1981 | European Pat. Off. | 206/509 |
| 2405192 | 6/1979 | France | 206/512 |
| 741969 | 12/1955 | United Kingdom | 206/511 |
| 2076366 | 12/1981 | United Kingdom | 206/512 |
| 1034952 | 8/1983 | U.S.S.R. | 220/1.5 |

*Primary Examiner*—George E. Lowrance

*Attorney, Agent, or Firm*—Russell E. Hattis; Lawrence J. Bassuk

[57] ABSTRACT

A container replacing a 55-gallon drum is substantially elongate rectangular with a length and width equal to or greater than its height to present a low center of gravity. An upstanding lip on a top wall and a depending lip on a bottom wall rest within one another to prevent lateral shifting of stacked containers. The lips have pairs of registered notches along all four sides to facilitate fork lifting from any side. The bottom depending lip spaces the bottom wall of the container from a floor to create a space for receiving the lift truck tines thereunder. The nesting depending and upstanding lips likewise create a space between stacked containers for receiving the lift truck tines therebetween. Openings in the top wall and both end walls provide access to the internal storage chamber, and the openings are protected from damage by overhanging top and bottom walls and the upstanding lip. The upstanding lip also includes perforations for lifting the container with such as rope, slings or chains from above.

11 Claims, 5 Drawing Figures

MODULAR CONTAINER

BACKGROUND OF THE INVENTION

This invention relates generally to closed containers, used industrially and commercially, to store and transport liquids and solids, and particularly to a container that replaces the standard 55-gallon drum.

Millions of 55-gallon drums have been used to store and transport liquids and solids. Their use, however, presents some problems that until now have been grudgingly accepted and accommodated.

A major problem has been the loss of transport and storage volume because the drums are cylindrical while warehouses, trucks and railroad cars are rectangular. Thus, even when the drums abut one another there is significant lost volume in the interstices between the drums. Generally, the weight of the drums and contained material is less than what the storage or transport space could safely carry so that the interstical space, which otherwise could contain more material, is just wasted. No acceptable container previously was available to take advantage of this unused space and the inefficiency was accepted.

Another significant problem with drums concerns their handling; drums are awkward and not readily handled by fork lift trucks. This problem has been accommodated by dedicating certain lift trucks to have special drum gripping devices or by providing special attachments for the tines of standard fork lift trucks. In either case, the drums are lifted only by either clamping around their sides or by clamping onto their top chimes or rims. Bottom lifting, without a skid, is impractical because of the cylindrical drum bottom not well mating with the long, narrow fork tines and the lack of access space under a drum. Bottom lifting also is impractical because drums inherently have a high center of gravity that makes them relatively unstable when upstanding. The special handling equipment and attachments operate satisfactory generally, but care must be exercised by operators to avoid crushing the drums during lifting and to avoid upsetting the drums during handling.

A further problem with drums concerns stacking. Drums have only top and bottom chimes or narrow rims extending from the side walls that are difficult to align closely for enabling the drums safely to be stacked one on top of another without shifting. The inherent instability of the drums, because of their high center of gravity, further contributes to the difficulty of stacking the drums safely.

It is known, see U.S. Pat. No. 3,942,670 to Mingus et al., to band four drums together and affix to the bottom of each drum a frusto-conical base plate having a single lift-tine receiving inverted U-shaped channel extending therethrough. The drums and base plate are arranged so that the U-channels form aligned passages for receiving the two parallel tines of a standard lift truck therethrough which can gain access to the drum in only one direction. The banded together four barrels then serve to stabilize one another when they are lifted from below by the lift truck. Additionally, when drums are stacked on one another, the conical base plates fit within the top rims of the underlying drums to stabilize same. This solution to the described problems is not believed practical, however, because four drums must always be banded together for the lift truck function to operate properly. One drum should not be lifted alone because of the instability rendered by its high center of gravity.

Further, the drums easily can slip within the band to positions where the U-channels are misaligned.

An additional problem with 55-gallon drums is that the only access to the interior storage chamber of the drum is through the bung holes in the top wall or cover. Liquids must be pumped out of a standing drum, or a special carriage or cradle must be used safely to tip or rotate the drum to a horizontal position in which the liquid can be poured out of the drum. Removing solids from a drum present similar problems. Lastly, damaging a drum, which occurs easily, can easily result in the contained materials leaking out.

Designers of other drums and closed and open containers have attempted to solve some of these described problems associated with 55-gallon drums. U.S. Pat. No. 4,485,924 to Ripoll discloses an upright rectangular drum. A lower skirt, crimped to the bottom edge of the drum, defines an outwardly extending peripheral step that engages or mates with the rim of an underlying drum to pass the weight of a stacked drum to the sidewalls of a therebelow stacked drum. The skirt also includes four corner located feet that are suspended above the lid of the next lower drum when two drums are stacked on one another. Limited access to the opening in the lid of the drum is through centrally located openings on the sides of the skirt. No suggestion of lifting the drum with the tines of a lift truck is made in Ripoll, possibly because of the single, narrow centered opening in each side of the skirt and the high center of gravity thereof creating an unstable lifting condition. The Ripoll container is also more expensive to assemble than the present 55 gallon drum.

U.S. Pat. No. 3,547,299 to Kepple discloses a cube shaped closed container having four embossed side walls and top and bottom end plates welded to the peripheral, outwardly extending flanges of the side walls. The Kepple patent states that the cubic design facilitates lifting with a lift truck, but no structure is disclosed for accepting tines under the container and the disclosed lifting procedure is from above by chains and supplemental corner cleats. No structure is disclosed to prevent stacked containers from sliding off one another. Further, access to the container contents is through a recessed opening in the top plate that can easily be covered by an above stacked container.

There are many other patents for closed and opened containers that address one or some of the problems associated with 55-gallon drums, such as liftability, stackability and access to the contents. Those patents, however, fail to achieve the simplicity of design and manufacture of the present invention while overcoming the problems associated therewith.

SUMMARY OF THE INVENTION

The above mentioned and other problems relating to 55-gallon drums are overcome by a modular container that combines various features not heretofore provided. The outer dimensions of a hollow modular container of the invention are preferably of substantially elongate rectangular shape to maximize the use of available volume and the dimensions are arranged substantially to provide a low profile and a low center of gravity.

The bottom wall of the container has a peripheral flange or lip vertically depending therefrom that carries the weight of the container with the bottom edge margin of the flange intended to rest upon such as a floor or the top wall of an underlying, stacked, like container.

The depending peripheral lip spaces the bottom wall from a floor or underlying container and thus carries the weight of all containers above it. The depending lip also has a pair of lift truck tine-receiving notches in each side allowing a standard truck to lift the container off the floor or other container from either one of the two passable stacking orientations of the containers. The container top wall also has a peripheral flange or lip vertically upstanding therefrom that surrounds or mates with the depending lip of an overlying stacked container to prevent lateral shifting of the overlying container and insure safe stacking of the containers. The upstanding lip thus carries no weight of the overlying container. Alternatively, the upstanding lip of one container can rest inside the depending lip of a thereabove stacked container. The upstanding lip of the one container then carries the weight of the stacked container, and the depending lip of the stacked container carries no weight. The upstanding lip also includes lift truck tine-receiving notches registered with the like notches of the depending lip to enable passage of the tines between two stacked containers.

The above described container, for example, differs from the Ripoll patent container in a number of aspects. The Ripoll container is a square container and has a high profile. Also the weight is carried directly on the interengaging vertically extending side walls and not on the top or bottom walls.

Access to interior the container is by top wall located openings and end wall located openings. The contents of the containers thus easily is accessed through the end wall openings without tipping or rotating the container and when the containers are stacked upon one another. Further, the top wall openings are protected from damage caused by abutting containers by the upstanding lip or flange and both the upstanding and depending lips or flanges overhang the end walls to protect the covers or seals of openings thereof from like damage.

The most preferred form of the container is simply and inexpensively manufactured by stamping similar top and bottom walls and bending sheet metal for the four side walls. The depending and upstanding peripheral lips or flanges are formed by bending margins of the top and bottom walls and joining the corners. The top, bottom and side walls, then are joined to form an integral structure. The top wall and upstanding flange of the present invention thus form an upwardly opening upper tray and the bottom wall and depending flange form a downwardly opening bottom tray.

The top and bottom walls with their respective lips are stamped flat from sheet or plate material and the margins are bent upwardly or downwardly to form the respective upstanding or depending lips. A strip of material is bent to form the end and side walls and is welded or otherwise joined to the top and bottom walls. The openings in the end and top walls can be stamped in the strip before bending with standard threaded sleeves welded or otherwise fixed in place thereat.

Alternatively, the container can be formed of molded plastic material in two halves that are then joined together along a median seam across the length of the top, bottom and end walls.

The container of the invention can be fork lifted from any one of the four side and end walls. This is obtained by the registered pairs of notches in each of the upstanding and depending peripheral lips or flanges at each of the side and end walls. The notches provide for receiving the lift truck tines while the lips or flanges space the top and bottom walls from one another, or a floor, to provide the necessary space therebetween for entry of the fork tines. This differs from Rolfe U.S. Pat. No. 4,287,997 where plural structural members distributed across the top and bottom walls space the stacked containers from one another or a floor and provide channels for receiving the lift truck tines. Also, the container of the preferred form of the present invention has lift openings or perforations near the corners of the top peripheral lip or flange. The container thus can be raised or lowered by a chain or rope passed through the lift openings.

Other aspects of the invention will become apparent upon making reference to the specification, drawing and claims.

DESCRIPTION OF THE PREFERRED EMBODIMENT

Figure 1:
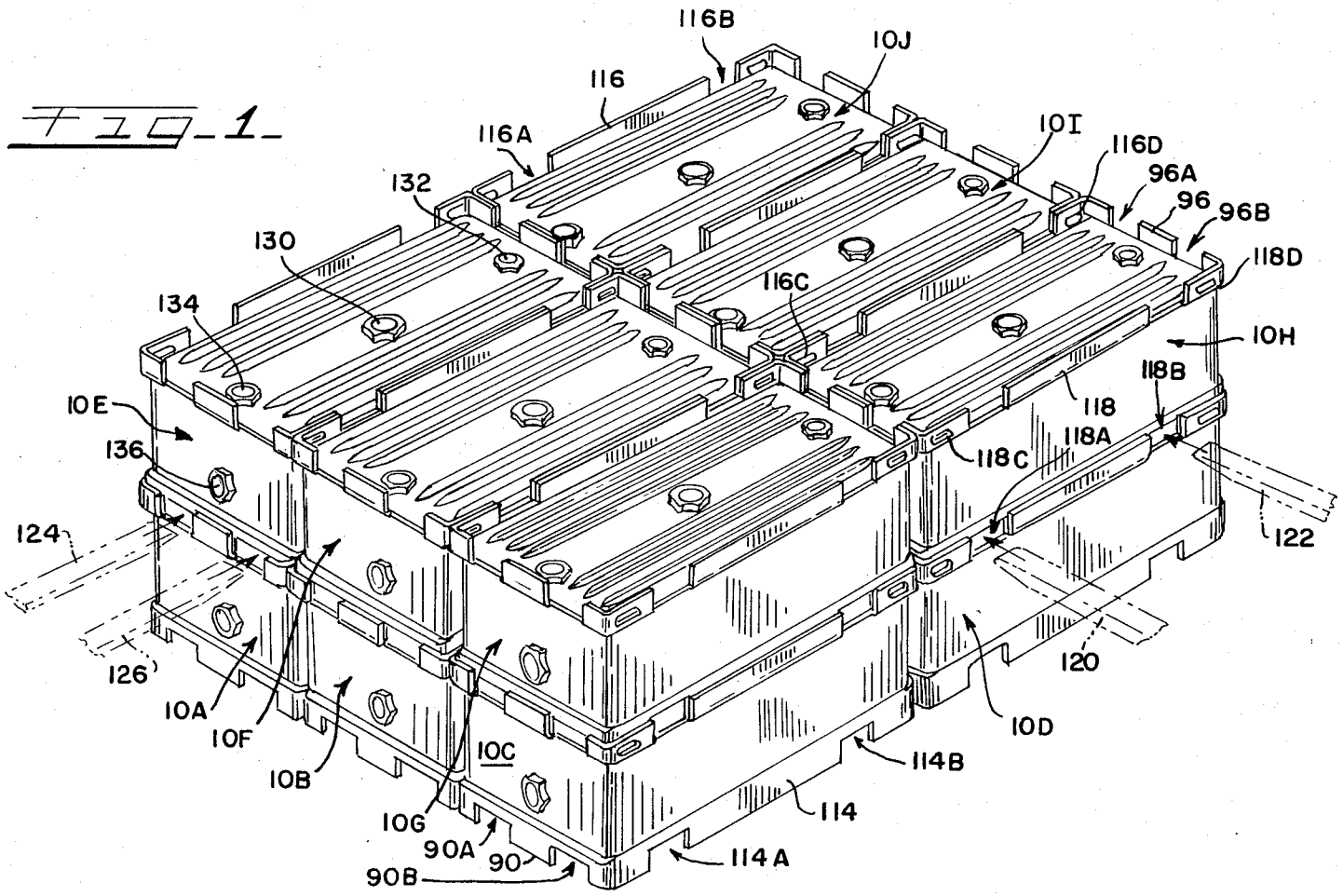
FIG. 1 is a perspective view of plural containers of the invention stacked together with two pairs of tines of a fork lift truck shown in dashed line outline.

In FIG. 1, a plurality (twelve) of identical modular, box-like containers 10 of the invention are stacked together in an arrangement three across, two high and two deep. In this view, only four lower containers 10A through 10D are visible while all six top containers 10E through 10J are visible. The containers 10 are substantially elongated rectangular solids and can therefore be closely stacked against one another and over and under one another efficiently to use the space occupied. Their rectangular construction and arrangement avoids the wasted interstical spaces between 55-gallon drums. Because the containers have a horizontally elongated shape, as contrasted to cylindrical or square containers having a vertically elongated shape, they have a low, stable center of gravity and can more flexibly be arranged in one of two possible orientations where the longest dimension can be aligned with the available storage area involved. The upper containers 10E through 10J interlock on the lower containers 10A–10D and the two containers not visible in this view to prevent lateral shifting thereof. The upper and lower containers are each able to be lifted by the tines 120, 122 and 124, 126 of a standard fork lift truck (not shown) without need of special adapters and the storage chambers in each container are readily accessible through top and end openings 130, 132, 134 and 136, even when the containers are stacked on one another.

Figure 2:
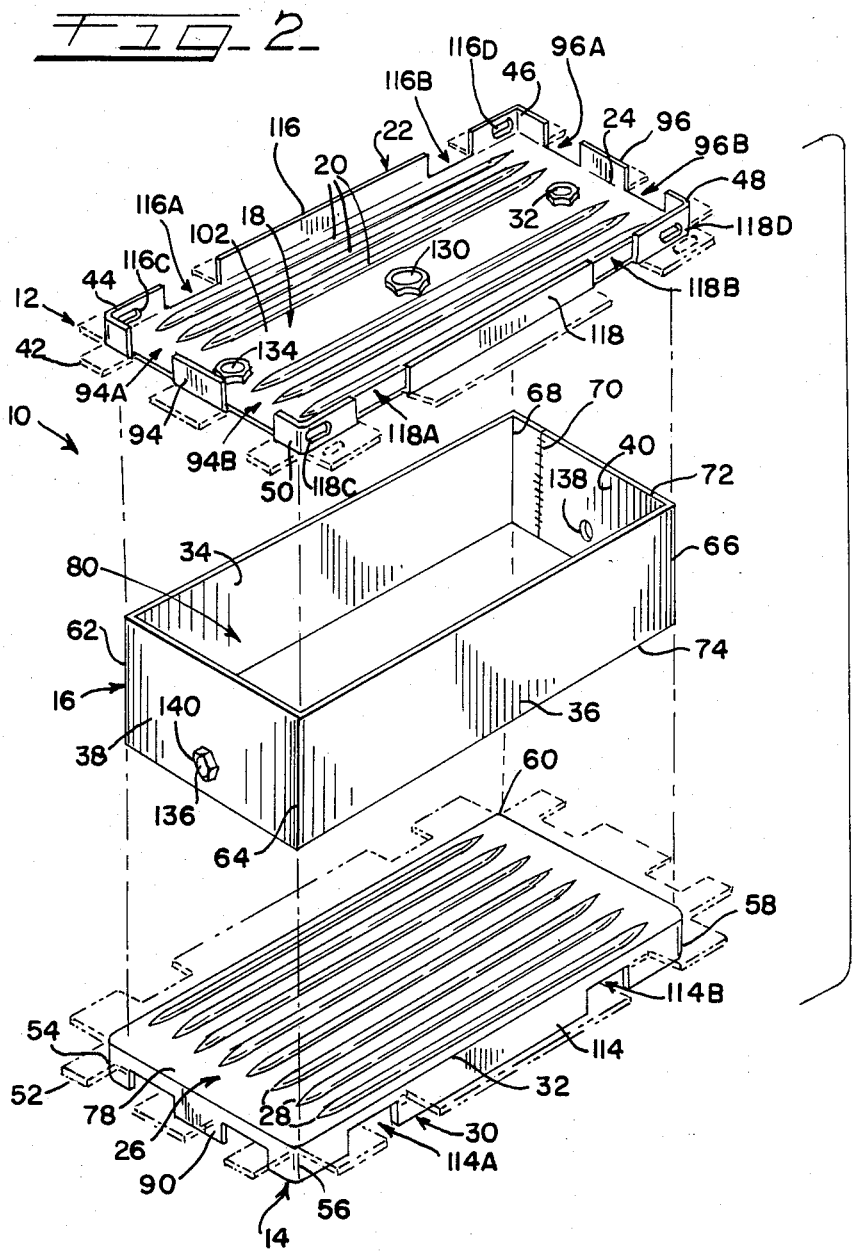
FIG. 2 is an exploded perspective view of a container of the invention.

In FIG. 2, modular container 10 comprises a top tray 12, a bottom tray 14 and a joined strip or integral sleeve 16 forming four rectangular walls. Top tray 12 comprises a planar, rectangular top wall 18 having longitudinal strengthening ribs 20 stamped therein and a circumferential upstanding peripheral lip or flange 22 at the peripheral margin 24 of the top wall 18. Bottom tray 14 has a construction similar to that of top tray 12 and comprises a planar, rectangular bottom wall 26, longitudinal strengthening ribs 28 and a circumferential depending peripheral lip or flange 30 at the peripheral margin 32 of the bottom wall 26. Sleeve 16 comprises a pair of long, rectangular side walls 34 and 36 and a pair of narrow rectangular end walls 38 and 40.

In a preferred embodiment of the invention, the top and bottom trays 12 and 14 are stamped from sheet steel. In top tray 12, this forms the top wall 18 with rigidifying ribs 20. The top tray peripheral lip 22 is stamped integral with the stamped top wall 18, but planar therewith in the form of an extending lip 42 shown in dashed line outline in FIG. 2. The extending lip 42, simultaneously with the stamping operation or thereafter, is bent upwardly and is joined at the four corner seams 44, 46, 48 and 50 by such as welding to obtain the upstanding peripheral lip 22.

Bottom tray 14 likewise is stamped to form bottom wall 26 with rigidifying ribs 28. The peripheral lip 30 is stamped integral with the stamped bottom wall, but planar therewith in the form of an extending lip 52 shown in dashed line outline in FIG. 2. Extending lip 52, also simultaneously with the stamping operation or thereafter, is bent downwardly and is joined at the four corner seams 54, 56, 58, and 60 thereof by such as welding to obtain the depending peripheral lip 30.

Although the terms upwardly and downwardly and upstanding and depending are used to describe the lips 22 and 30, these are relative terms describing structure resulting in a finished product of the preferred embodiment. Top and bottom trays 12 and 14 can be stamped and bent in any desired orientation to obtain the structure embodying the invention.

Sleeve 16, in a preferred form of the embodiment, is formed from a strip of sheet or plate steel bent at right angles along the corner seams 62, 64, 66, and 68, and joined by such as welding at a butt joint 70 into an integral, four walled member. The width of the strip of steel determines the height of the sleeve, from a top margin 72 to a bottom margin 74, and the length of the strip determines the circumference or total lengths of the four sides, from corner seams to corner seams.

Figure 4:
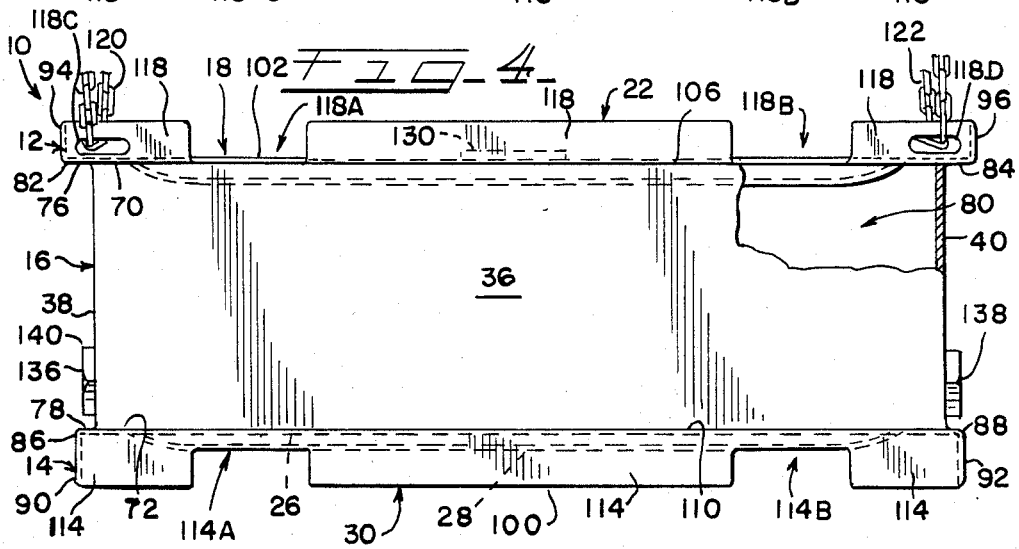
FIG. 4 is a side elevation view of the container being lifted by chains.

Referring also to FIG. 4, sleeve 16 is secured to top tray 12 and bottom tray 14 by joining, such as by welding, the top margin 70 of sleeve 16 to the bottom side surface 76 of top wall 18 and by joining, also such as by welding, the bottom margin 72 of sleeve 16 to the top side surface 78 of bottom wall 26. This forms a storage chamber 80 inside container 10 that is closed on six sides by the top and bottom walls 18 and 26, the side walls 34 and 36 and end walls 38 and 40.

Figure 3:
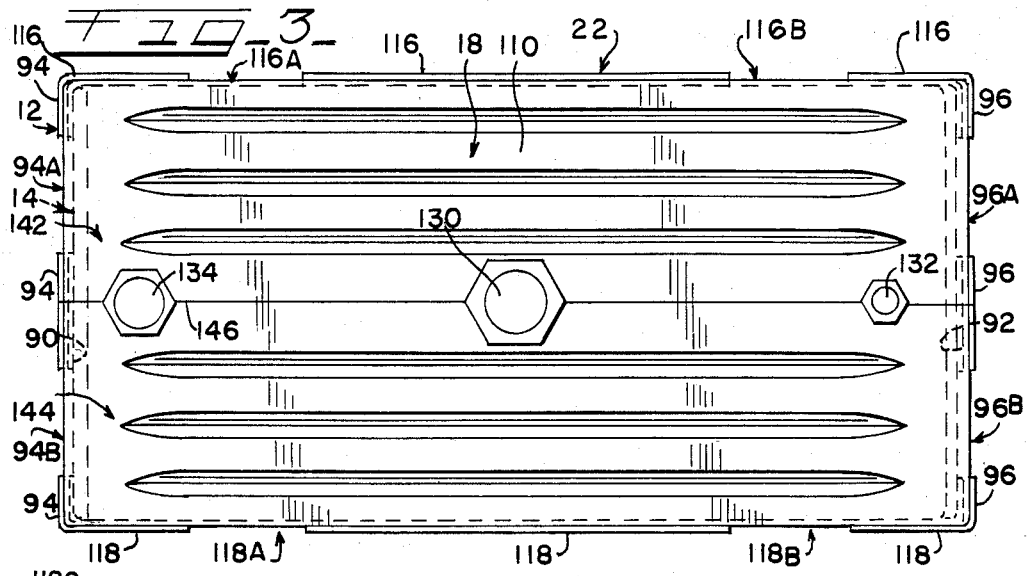
FIG. 3 is a top view of the container.
Figure 5:
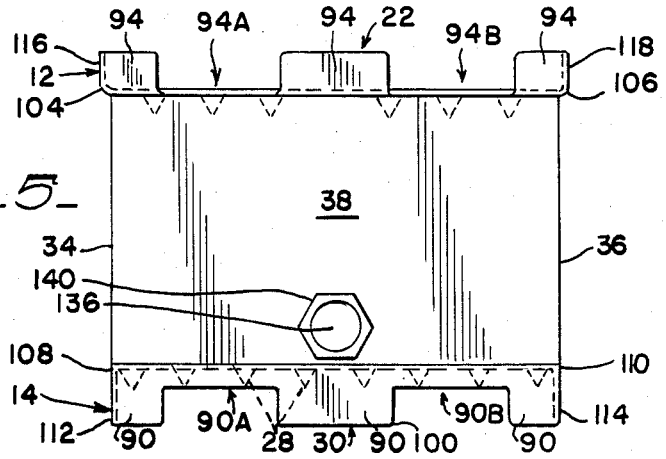
FIG. 5 is an end elevation view of the container.

Referring also to FIGS. 3 and 5, the top and bottom trays 12 and 14 are dimensional relative to one another so that the peripheral lip 30 of the bottom tray will rest inside the peripheral lip 22 of the top tray to prevent slippage of two containers arranged stacked one on top of the other, such as is illustrated in FIG. 1. In particular in FIGS. 3 and 4, end margins 82 and 84 of top tray 12 or top wall 18 overhang or extend beyond like end margins 86 and 88 of bottom tray 14 or bottom wall 26 sufficiently for the end portions 90 and 92 of the peripheral lip 30 depending from the end margins 86 and 88 clearly to fit between the end portions 94 and 96 of the peripheral lip 22 upstanding from the end margins 82 and 84. In such a position, the bottom margin 100 of the depending lip 30 rests upon the top side surface 102 of top wall 18.

In particular in FIGS. 3 and 5, side margins 104 and 106 of top tray 12 on top wall 18 overhang or extend beyond the side margins 108 and 110 of bottom tray 14 or bottom wall 26 sufficiently for the side portions 112 and 114 of the peripheral lip 30 depending from the end margins 108 and 110 clearly to fit between the side portions 116 and 118 of the peripheral lip 22 upstanding from the side margins 104 and 106. Further, in this embodiment, the side margins 108 and 110 of the bottom wall 26 only slightly overhang the side walls 34 and 36, to facilitate welding or fabrication, while all other side and end margins, top and bottom, substantially overhang the side walls 34 and 36 and end walls 38 and 40. When two like containers 10 are stacked on one another, the side and end portions of the depending lip 30 are completely surrounded by the side and end portions of the upstanding lip 22. The upstanding lip of the lower container thus holds the depending lip of the upper container to prevent any lateral shifting of the containers relative to one another, alleviating the problem of shifting prevalent with 55-gallon drums. Several containers 10 thus safely can be stacked on one another.

Referring to FIGS. 1, 4 and 5, while the upstanding lip 22 secures a stacked or overhead container 10 from lateral movement, depending lip 30 spaces the bottom wall 26 of the stacked container from the top wall 18 of the supporting or underneath container a distance sufficient for the tines 120 and 122, and 124 and 126 of a standard fork lift truck to be inserted therebetween. Standard fork lift trucks thus can be used to stack and unstack the containers upon one another, obviating the prior need for special trucks or adapters used for lifting 55-gallon drums. Moreover, each of the side portions and end portions of the upstanding and depending peripheral lips are provided with a pair of notches, such as notches 118A and 118B and 114A and 114B in FIG. 4 and notches 94A and 94B and 90A and 90B in FIG. 5, enabling the tines 120 and 122, and 124 and 126 of the fork lift truck to pass through the otherwise solid lips and into the space between the separated bottom walls and top walls of the stacked containers. The notches of the upstanding and depending lips are registered with one another to facilitate passage of the tines therethrough even when the containers are stacked on one another. Further, the depending lip will space the bottom wall 26 from a floor or other flat carrying surface a distance sufficiently for a single container to be lifted by a standard lift truck, the tines of which fit through the associated notches. Two or more stacked containers thus also can be lifted by the truck by the lift tines being inserted under the bottom wall of the bottom stacked container. Such lifting of 55-gallon drums is not possible without a special lift truck or adapter, or without pallets between stacked drums or drums sitting on a floor.

Referring to FIGS. 3 and 4, the side portions 116 and 118 of the upstanding lip 22 each include a pair of perforations C and D at the ends thereof through which lifting lines such as chains 120 and 122 or chain hooks can be passed to raise, lower and carry container 10 with an overhead hoist (not shown) instead of a lift truck. There are four such perforations in upstanding lip 22, two each in side portions 116 and 118 used for lifting the containers even though only two claims are shown in FIG. 4. Perforations C and D also can be used for lashing or securing the container in position in a truck, plane or on a ship.

Referring to FIGS. 2, 3, 4 and 5, access to storage chamber 80 inside container 10 for loading material or liquids therein and for unloading same therefrom, is through openings 130, 132 and 134 in top wall 18, opening 136 in end wall 38 and opening 138 in end wall 40. Each opening is closed by a threaded plug, such as plug 140 closing opening 136. The openings in the top and end walls, when cleared by removal of the threaded plugs, provide for easy withdrawal of material from storage chamber 80 without having to change the position of the container 10. This holds if the container to which access is desired is resting on a floor alone, or is anywhere in a stack of several containers. In the preferred embodiment, the openings 130, 136 and 138 are two inches in diameter and openings 132 and 134 are $\frac{3}{4}$ inch in diameter. Other openings and diameters can be provided as desired.

Openings 130, 132 and 134 and perforations 116C and D and 118C and D can be punched at the same time as top tray 12 is stamped or they can be formed otherwise as desired. Openings 136 and 138 can be stamped, punched or drilled as desired.

The openings and their associated plugs are protected from damage caused by one container smashing into another by the overhanging peripheral lips 22 and 30 and by the upstanding lip 30. In FIG. 4, the end margin 82 of top wall 18 and the end margin 86 of bottom wall 26 extend outwardly from end wall 38 a distance sufficient to extend beyond the plug 140 of opening 136, effectively protecting plug 140 and opening 136 from damage caused by another container being moved in close proximity thereto or abutting the container 10, such as could occur when one container is being pushed against another by a lift truck inside the hold of a ship or inside the cargo box of a truck. In a similar manner, upstanding lip 22 projects above the top surface 102 of top wall 18 sufficiently to protect the plugs of openings 130, 132 and 134 from damaging side blows.

In an alternative embodiment, container 10 can be molded of plastic material. In FIG. 3, the container is molded in two longitudinally symmetrical halves 142 and 144 that are joined together along a median seam 146 extending the length of top wall 18. It will be understood that this seam 146 extends around the container including end walls 38 and 40 and bottom wall 26 even though this is not specifically shown in the drawing. In the plastic molded embodiment, the openings 130–138 are preferably molded to lie along the seam for ease of manufacture of the molds.

In FIGS. 4 and 5, ribs 28 depend from bottom wall 26 of bottom tray 14 a distance substantially the height of the pairs of notches, such as 90A and 90B and 114A and 114B. The tines of a lift truck inserted therein thus, when the container 10 is being carried by the tines, engage against the ribs 28 and not the bottom wall 26.

The container 10 of the invention thus is easy to manufacture from stamped top and bottom trays and a bent strip forming the end and side walls welded together. Such construction lends itself to automation, particularly of the welding, and results in an inexpensive product. The container overcomes or eliminates all of the drawbacks associated with 55-gallon drums to achieve a superior storage and transportation container for liquids or solids.

I claim:

1. A container for transporting and storing liquids and solids that can be carried by the tines of a fork lift truck, said container comprising:

A. a horizontally elongated rectangular box having a horizontal top wall, a horizontal bottom wall, a pair of opposed vertical end walls and a pair of opposed vertical side walls joined together to enclose a storage chamber therein, the horizontal length of said box being at least about twice the height thereof to present a relatively low center of gravity, relative to a vertically elongated container;

B. a peripheral lip upstanding from said top wall around at least a portion of the circumference thereof, said upstanding lip including notch means along each of the ends and sides of said top wall adapted to receive therethrough said tines of said lift truck for lifting said container; and C. a peripheral lip depending from said bottom wall around at least a portion of the circumference thereof, said depending lip including notch means along each of the ends and sides of said bottom wall in registration with said notch means in said upstanding lip and adapted to receive therethrough said tines of said lift truck for lifting said container;

D. said upstanding lip and depending lip being constructed and arranged so that when one container is stacked on another container, said depending lip of said one container can mate with the upstanding lip of said other container to prevent lateral movement therebetween with said one container being carried by one of said depending lip and said upstanding lip to space apart the juxtaposed top and bottom walls of said stacked containers.

2. The container of claim 1 in which at least one of said vertical walls includes near the bottom thereof a sealed exposed opening therethrough for access to said storage chamber and at least one of said top and bottom walls has at least one margin that extends horizontally beyond said one vertical wall including said opening to protect said sealed exposed opening from damage while facilitating flush abutment of said containers.

3. The container of claim 2 in which both of said vertical end walls includes near the bottom thereof a sealed exposed opening therethrough for access to said storage chamber and both of said top and bottom walls have an end margin that extends horizontally beyond said vertical end walls to protect said sealed exposed opening from damage while facilitating flush abutment of said containers.

4. A container for transporting and storing liquids and solids that can be carried by the tines of a fork lift truck, said container comprising:

A. a rectangular box having a horizontal top wall, a horizontal bottom wall, a pair of opposed vertical end walls and a pair of opposed vertical side walls joined together to enclose a storage chamber therein;

B. a peripheral lip upstanding from said top wall around at least a portion of the circumference thereof, said upstanding lip including notch means along each of the ends and sides of said top wall adapted to receive therethrough said tines of said lift truck for lifting said container; and C. a peripheral lip depending from said bottom wall around at least a portion of the circumference thereof, said depending lip including notch means along each of the ends and sides of said bottom wall in registration with said notch means in said upstanding lip and adapted to receive therethrough said tines of said lift truck for lifting said container;

D. said upstanding lip and depending lip being constructed and arranged so that when one container is stacked on another container, said depending lip of said one container can mate with the upstanding lip of said other container to prevent lateral movement therebetween with said one container being carried by one of said depending lip and said upstanding lip to space apart the juxtaposed top and bottom walls of said stacked containers; and E. at least one of said vertical walls includes near the bottom thereof a sealed exposed opening therethrough for access to said storage chamber and at least one of said top and bottom walls has at least one margin that extends horizontally beyond said one vertical wall including said opening to protect said sealed exposed opening from damage while facilitating flush abutment of said containers.

5. The container of claim 4 in which both of said vertical end walls includes near the bottom thereof a sealed exposed opening therethrough for access to said storage chamber and both of said top and bottom walls have an end margin that extends horizontally beyond said vertical end walls to protect said sealed exposed opening from damage while facilitating flush abutment of said containers.

6. The container of claims 2 or 4 in which two opposed vertical walls include said sealed exposed openings and at least one of said top and bottom walls have two opposed margins that overhang said opposed vertical walls.

7. A container for transporting and storing liquids and solids that can be carried by the tines of a fork lift truck, said container comprising:

A. a rectangular box having a horizontal top wall, a horizontal bottom wall, a pair of opposed vertical end walls and a pair of opposed vertical side walls joined together to enclose a storage chamber therein;

B. a peripheral lip upstanding from said top wall around at least a portion of the circumference thereof, said upstanding lip including notch means along each of the ends and sides of said top wall adapted to receive therethrough said tines of said lift truck for lifting said container; and C. a peripheral lip depending from said bottom wall around at least a portion of the circumference thereof, said depending lip including notch means along each of the ends and sides of said bottom wall in registration with said notch means in said upstanding lip and adapted to receive therethrough said tines of said lift truck for lifting said container;

D. said upstanding lip and depending lip being constructed and arranged so that when one container is stacked on another container, said depending lip of said one container can mate with the upstanding lip of said other container to prevent lateral movement therebetween with said one container being carried by its depending lip engaging against the top wall of said other container to space apart the juxtaposed top and bottom walls of said stacked containers; and E. said top wall includes at least one sealed exposed opening therethrough for access to said storage chamber and said upstanding lip extends above said opening to protect the same from damage.

8. The container of claim 7 in which said top wall includes plural sealed exposed openings all protected by said upstanding lip.

9. A container for transporting and storing liquids and solids that can be carried by the tines of a fork lift truck, said container comprising:

A. a rectangular box having a horizontal top wall, a horizontal bottom wall, a pair of opposed vertical end walls and a pair of opposed vertical side walls joined together to enclose a storage chamber therein;

B. a peripheral lip upstanding from said top wall around at least a portion of the circumference thereof, said upstanding lip including notch means along each of the ends and sides of said top wall being adapted to receive therethrough said tines of said lift truck for lifting said container; and C. a peripheral lip depending from said bottom wall around at least a portion of the circumference thereof, said depending lip including a notch means along each of the ends and sides of said bottom wall in registration with said notch means in said upstanding lip and adapted to receive therethrough said tines of said lift truck for lifting said container;

D. said upstanding lip and depending lip being constructed and arranged so that when one container is stacked on another container, said depending lip of said one container can mate with the upstanding lip of said other container to prevent lateral movement therebetween with said one container being carried by its depending lip engaging against the top wall of said other container to space apart the juxtaposed top and bottom walls of said stacked containers; and E. said bottom wall includes strengthening and rigidifying ribs depending therefrom and said notch means in said depending lip have a height coinciding with the bottom of said ribs so that lift truck tines inserted into said notch means engage against said depending ribs for carrying said container.

10. The container of claims 1, 4, 7 or 9 in which said upstanding lip includes perforations therethrough for carrying said container.

11. The container of claims 1, 4, 7 or 9 in which said depending lip of said one stacked container rests on the top wall of said another container to carry the weight of said stacked container on said another container and said upstanding lip of said another container surrounds said depending lip of said one stacked container.

* * * * *